US010103449B2

(12) United States Patent
Wong et al.

(10) Patent No.: US 10,103,449 B2
(45) Date of Patent: Oct. 16, 2018

(54) ANTENNA ARRAY

(71) Applicant: Industrial Technology Research Institute, Hsinchu (TW)

(72) Inventors: Kin-Lu Wong, Kaohsiung (TW); Jun-Yu Lu, Kaohsiung (TW); Wei-Yu Li, Yilan (TW)

(73) Assignee: INDUSTRIAL TECHNOLOGY RESEARCH INSTITUTE, Hsinchu (TW)

( * ) Notice: Subject to any disclaimer, the term of this patent is extended or adjusted under 35 U.S.C. 154(b) by 387 days.

(21) Appl. No.: 14/984,590

(22) Filed: Dec. 30, 2015

(65) Prior Publication Data

US 2017/0162948 A1 Jun. 8, 2017

(30) Foreign Application Priority Data

Dec. 8, 2015 (TW) ..... 104141055 A

(51) Int. Cl.
*H01Q 21/06* (2006.01)
*H01Q 5/10* (2015.01)
(Continued)

(52) U.S. Cl.
CPC ..... *H01Q 21/06* (2013.01); *H01Q 1/243* (2013.01); *H01Q 1/38* (2013.01); *H01Q 1/523* (2013.01); *H01Q 5/10* (2015.01)

(58) Field of Classification Search
CPC ..... H01Q 1/24–1/243; H01Q 21/06; H01Q 5/10; H01Q 1/38; H01Q 1/523
See application file for complete search history.

(56) References Cited

U.S. PATENT DOCUMENTS 4,460,899 A 7/1984 Schmidt et al.
5,952,983 A 9/1999 Dearnley et al.
(Continued)

FOREIGN PATENT DOCUMENTS

CN 101316008 A 12/2008
CN 102683807 A 9/2012
(Continued)

OTHER PUBLICATIONS

Extended European Search Report, dated May 10, 2017, for European Application No. 15202618.3.
(Continued)

*Primary Examiner* — Dameon E Levi
*Assistant Examiner* — Jennifer F Hu
(74) *Attorney, Agent, or Firm* — Birch, Stewart, Kolasch & Birch, LLP

(57) ABSTRACT

An antenna array includes a ground conductor portion, a first antenna and a second antenna. The ground conductor portion has a first edge and a second edge. The first antenna has a first no-ground radiating area and a first feeding conductor portion. The second antenna has a second no-ground radiating area and a second feeding conductor portion. The first no-ground radiating area is formed and surrounded by a first grounding conductor structure, a second grounding conductor structure, and the first edge, and the first no-ground radiating area has a first breach. The second no-ground radiating area is formed and surrounded by a third grounding conductor structure, a fourth grounding conductor structure, and the second edge, and the second no-ground radiating area has a second breach. The first and second feeding conductor portions are respectively and electrically connected to a first signal source and a second signal source.

12 Claims, 10 Drawing Sheets

(51) Int. Cl.

| | |
|---|---|
| ***H01Q 1/24*** | (2006.01) |
| ***H01Q 1/38*** | (2006.01) |
| ***H01Q 1/52*** | (2006.01) |

(56) References Cited

U.S. PATENT DOCUMENTS

| | | | | |
|---|---|---|---|---|
| 5,990,838 | A | 11/1999 | Burns et al. | |
| 6,104,348 | A | 8/2000 | Karlsson et al. | |
| 6,288,679 | B1 | 9/2001 | Fischer et al. | |
| 6,344,829 | B1 | 2/2002 | Lee | |
| 6,426,723 | B1 | 7/2002 | Smith et al. | |
| 6,624,789 | B1 | 9/2003 | Kangasvieri et al. | |
| 7,250,910 | B2 | 7/2007 | Yoshikawa et al. | |
| 7,271,777 | B2 | 9/2007 | Yuanzhu | |
| 7,315,289 | B2 * | 1/2008 | Puente Baliarda | H01Q 1/36 343/817 |
| 7,330,156 | B2 | 2/2008 | Arkko et al. | |
| 7,352,328 | B2 | 4/2008 | Moon et al. | |
| 7,385,563 | B2 | 6/2008 | Bishop | |
| 7,405,699 | B2 | 7/2008 | Qin | |
| 7,425,924 | B2 * | 9/2008 | Chung | H01Q 1/38 343/702 |
| 7,460,069 | B2 | 12/2008 | Park et al. | |
| 7,498,997 | B2 | 3/2009 | Moon et al. | |
| 7,541,988 | B2 | 6/2009 | Sanelli et al. | |
| 7,561,110 | B2 | 7/2009 | Chen | |
| 7,573,433 | B2 | 8/2009 | Qin | |
| 7,586,445 | B2 | 9/2009 | Qin et al. | |
| 7,609,221 | B2 | 10/2009 | Chung et al. | |
| 7,688,273 | B2 | 3/2010 | Montgomery et al. | |
| 7,710,343 | B2 | 5/2010 | Chiu et al. | |
| 7,714,789 | B2 | 5/2010 | Tsai et al. | |
| 7,733,285 | B2 | 6/2010 | Gainey et al. | |
| 7,825,863 | B2 * | 11/2010 | Martiskainen | H01Q 1/243 343/700 MS |
| 8,684,272 | B2 * | 4/2014 | Wong | H01Q 1/243 235/492 |
| 8,933,852 | B2 * | 1/2015 | Wong | H01Q 1/243 343/725 |
| 8,963,784 | B2 | 2/2015 | Zhu et al. | |
| 9,077,084 | B2 * | 7/2015 | Li | H01Q 5/321 |
| 9,190,733 | B2 * | 11/2015 | Desclos | H01Q 7/005 |
| 9,620,863 | B2 * | 4/2017 | Tanaka | H01Q 1/243 |
| 2003/0210206 | A1 * | 11/2003 | Phillips | H01Q 1/362 343/895 |
| 2007/0285321 | A1 | 12/2007 | Chung et al. | |
| 2008/0258992 | A1 * | 10/2008 | Tsai | H01Q 1/2266 343/853 |
| 2009/0009401 | A1 | 1/2009 | Suzuki et al. | |
| 2009/0322639 | A1 | 12/2009 | Lai | |
| 2010/0134377 | A1 | 6/2010 | Tsai et al. | |
| 2010/0156726 | A1 | 6/2010 | Montgomery et al. | |
| 2010/0156745 | A1 | 6/2010 | Andrenko et al. | |
| 2010/0156747 | A1 | 6/2010 | Montgomery | |
| 2010/0238079 | A1 | 9/2010 | Ayatollahi et al. | |
| 2010/0295736 | A1 | 11/2010 | Su | |
| 2010/0295750 | A1 | 11/2010 | See et al. | |
| 2011/0019723 | A1 | 1/2011 | Lerner et al. | |
| 2013/0050057 | A1 | 2/2013 | Hayashi et al. | |
| 2013/0099980 | A1 * | 4/2013 | Hayashi | H01Q 1/48 343/700 MS |
| 2013/0257674 | A1 * | 10/2013 | Li | H01Q 5/321 343/853 |
| 2014/0078018 | A1 * | 3/2014 | Wong | H01Q 21/28 343/893 |
| 2014/0085159 | A1 * | 3/2014 | Wong | H01Q 5/328 343/843 |
| 2014/0139388 | A1 | 5/2014 | Tanaka et al. | |
| 2016/0072195 | A1 * | 3/2016 | Milankovic | H01Q 1/526 343/841 |

FOREIGN PATENT DOCUMENTS

| | | | |
|---|---|---|---|
| EP | 2 584 649 | A1 | 4/2013 |
| TW | M294112 | U | 7/2006 |
| TW | I307565 | B | 3/2009 |
| TW | I321863 | B | 3/2010 |
| TW | 201405942 | A | 2/2014 |

OTHER PUBLICATIONS

Taiwanese Office Action and Search Report, dated Mar. 20, 2017, for Taiwanese Application No. 104141055.

Bae et al., "Compact Mobile Handset MIMO Antenna for LTE700 Applications", Microwave and Optical Technology Letters, Nov. 2010, vol. 52, No. 11, pp. 2419-2422.

Chen et al., "A Decoupling Technique for Increasing the Port Isolation Between Two Strongly Coupled Antennas", IEEE Transactions on Antennas and Propagation, Dec. 2008, vol. 56, No. 12, pp. 3650-3658.

Choi et al., "Performance Evaluation of 2×2 MIMO Handset Antenna Arrays for Mobile WiMAX Applications", Microwave and Optical Technology Letters, Jun. 2009, vol. 51, No. 6, pp. 1558-1561.

Chou et al., "Internal Wideband Monopole Antenna for MIMO Access-Point Applications in the WLAN/WiMAX Bands", Microwave and Optical Technology Letters, May 2008, vol. 50, No. 5, pp. 1146-1148.

Coetzee et al., "Compact Multiport Antenna with Isolated Ports", Microwave and Optical Technology Letters, Jan. 2006, vol. 50, No. 1, pp. 229-232.

Ding et al., "A Novel Dual-Band Printed Diversity Antenna for Mobile Terminals", IEEE Transactions on Antennas and Propagation, Jul. 2007, vol. 55, No. 7, pp. 2088-2096.

Ethier et al., "MIMO Handheld Antenna Design Approach Using Characteristic Mode Concepts", Microwave and Optical Technology Letters, Jul. 2008, vol. 50, No. 7, pp. 1724-1727.

Han et al., "MIMO Antenna Using a Decoupling Network for 4G USB Dongle Application", Microwave and Optical Technology Letters, Nov. 2010, vol. 52, No. 11, pp. 2551-2554.

Kang et al., "Isolation Improvement of 2.4/5.2/5.8 GHz WLAN Internal Laptop Computer Antennas Using Dual-Band Strip Resonator as a Wavetrap", Microwave and Optical Technology Letters, Jan. 2010, vol. 52, No. 1, pp. 58-64.

Kim et al., "Design of a Dual-Band MIMO Antenna for Mobile WiMAX Application", Microwave and Optical Technology Letters, Feb. 2011, vol. 53, No. 2, pp. 410-414.

Liu et al., "A Compact Wideband Planar Diversity Antenna for Mobile Handsets", Microwave and Optical Technology Letters, Jan. 2008, vol. 50, No. 1, pp. 87-91.

Shen et al., "A Novel Wideband Printed Diversity Antenna for Mobile Handsets", 2012 IEEE, 5 pages.

Su et al., "Printed Coplanar Two-Antenna Element for 2.4/5 GHz WLAN Operation in a MIMO System", Microwave and Optical Technology Letters, Jun. 2008, vol. 50, No. 6, pp. 1635-1638.

Su, "A Three-In-One Diversity Antenna System for 5 GHz WLAN Applications", Microwave and Optical Technology Letters, Oct. 2009, vol. 51, No. 10, pp. 2477-2481.

Su, "Concurrent Dual-Band Six-Loop-Antenna System with Wide 3-dB Beamwidth Radiation for MIMO Access Points", Microwave and Optical Technology Letters, Jun. 2010, vol. 52, No. 6, pp. 1253-1258.

European Office Action, dated Jan. 4, 2018, for European Application No. 15 202 618.3.

* cited by examiner

ANTENNA ARRAY

CROSS REFERENCE TO RELATED APPLICATION

The present application is based on, and claims priority from, Taiwan Application Number 104141055, filed on Dec. 8, 2015, the invention of which is hereby incorporated by reference herein in its entirety.

TECHNICAL FIELD

The disclosure relates to an antenna array design.

BACKGROUND

With advances in communication technology, more and more communication function could be implemented and integrated into a single portable communication device. The current systems which could be integrated into the portable communication device include Wireless Wide Area Network (WWAN) System, Long Term Evolution (LTE) System, Wireless Personal Network (WLPN) System, Wireless Local Area Network (WLAN) System, Near Field Communication (NFC) System, Digital Television Broadcasting System (DTV), Global Positioning System (GPS), and other wireless applications.

The rising demand for signal quality, reliability and transmission rate of wireless communication system causes rapid development in multi-antenna systems technology. For example, Multi-Input Multi-Output (MIMO) Antenna System, Pattern Switchable Antenna System, Beam-Steering/Beam-Forming Antenna System, etc. However, in a multi-antenna system, the envelope correlation coefficient (ECC) between multiple antennas increases when the multiple antennas operating in the same frequency band are jointly designed in a handheld communication device with limited available antenna space. Increasing envelope correlation coefficient (ECC) causes attenuation of the antenna radiation characteristics, this thereby causes decreased data transmission rate and increased technical difficulties and challenges with the multi-antenna integrated design.

Part of the literature in the prior art proposes a design approach that involves designing protruding or slit structures on the ground area between multiple antennas to serve as an energy isolator, so as to enhance energy isolation between multiple antennas. However the above design approach would lead to the triggering of additional coupling current on the ground area and thereby increases the envelope correlation coefficient (ECC) between multiple antennas.

In order to address the above issue, the present disclosure provides a multiple antenna array design approach with a low envelope correlation coefficient (ECC) to satisfy the practical demands of a future high data transmission rate multi-antenna system.

SUMMARY

Exemplary embodiments of the present disclosure disclose a multiple antenna array design. The above technical issue could be solved according to some exemplary embodiments and data transmission rate could be enhanced.

An embodiment of the present disclosure provides an antenna array. The antenna array comprises a ground conductor portion, a first antenna, and a second antenna. The ground conductor portion has at least one first edge and a second edge. The first antenna comprises a first no-ground radiating area and a first feeding conductor portion. The first no-ground radiating area is formed and surrounded by a first grounding conductor structure, a second grounding conductor structure, and the first edge, wherein the first grounding conductor structure and the second grounding conductor structure are electrically connected to the ground conductor portion and adjacent to the first edge; and wherein a first coupling distance is formed between the first grounding conductor structure and the second grounding conductor structure such that the first no-ground radiating area has a first breach. The first feeding conductor portion has a first coupling conductor structure and a first signal feeding conductor line, wherein the first coupling conductor structure is located in the first no-ground radiating area, the first coupling conductor structure is electrically coupled to or connected to a first signal source through the first signal feeding conductor line, and the first signal source excites the first antenna to generate at least one first resonant mode. The second antenna comprises a second no-ground radiating area and a second feeding conductor portion. The second no-ground radiating area is formed and surrounded by a third grounding conductor structure, a fourth grounding conductor structure, and the second edge, wherein the third grounding conductor structure and the fourth grounding conductor structure are electrically connected to the ground conductor portion and adjacent to the second edge; and wherein a second coupling distance is formed between the third grounding conductor structure and the fourth grounding conductor structure such that the second no-ground radiating area has a second breach. The second feeding conductor portion has a second coupling conductor structure and a second signal feeding conductor line, wherein the second coupling conductor structure is located in the second no-ground radiating area, the second coupling conductor structure is electrically coupled to or connected to a second signal source through the second signal feeding conductor line, the second signal source excites the second antenna to generate at least one second resonant mode, and the first resonant mode and the second resonant mode cover at least one common communication system band.

BRIEF DESCRIPTION OF THE DRAWINGS

The present disclosure can be more fully understood by reading the subsequent detailed description and examples with references made to the accompanying drawings, wherein.

DESCRIPTION OF THE EMBODIMENTS

The present disclosure provides an exemplary embodiment of an antenna array. Antennas of the antenna array is firstly designed specific grounding conductor structures to form a no-ground radiating area, and to effectively trigger the no-ground radiating area to generate radiating energy by designing a feeding conductor portion. In this way, the excited current would be mainly constrained around the no-ground radiating area. Thereby the correlation coefficient between multiple antennas could be effectively reduced. Besides, the no-ground radiating area of the present disclosure is designed to have a breach. The impedance matching level of a resonant mode generated by the antennas could be improved by adjusting the coupling distance of the breach and the area of the no-ground radiating area. In addition, adjusting the coupling distance of the breach and adjusting the distances between the breach and the breaches of other adjacent no-ground radiating areas could guide the antenna radiation pattern and thereby reduce the energy coupling level between the antenna and adjacent antennas. Adjusting the distance between breaches of adjacent no-ground radiating areas could effectively reduce the required width of the no-ground radiating area and thereby reduce the quality factor of the antenna array to enhance the antenna radiation characteristics.

Figure 1:
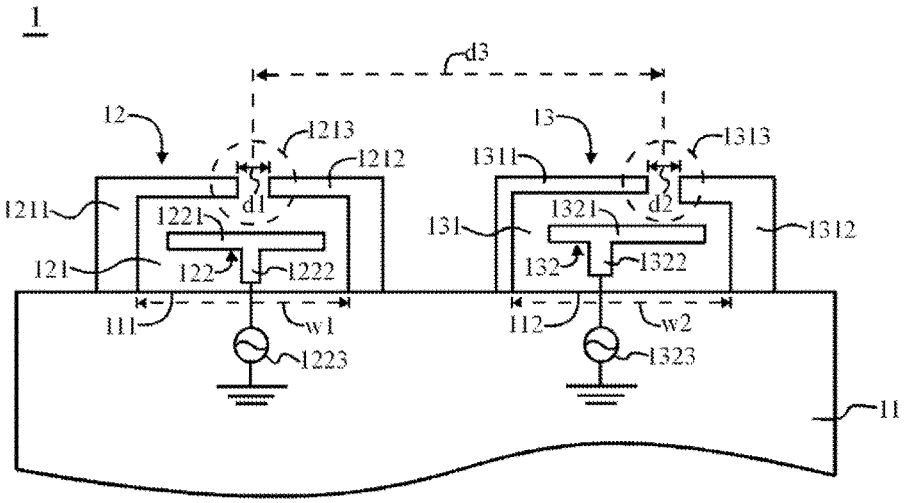
FIG. 1 shows a structural diagram of an antenna array 1 according to an embodiment of the present disclosure.

FIG. 1 shows a structural diagram of an antenna array 1 according to an embodiment of the present disclosure. The antenna array 1 comprises a ground conductor portion 11, a first antenna 12, and a second antenna 13. The ground conductor portion 11 has at least one first edge 111 and a second edge 112. The first antenna 12 comprises a first no-ground radiating area 121 and a first feeding conductor portion 122. The first no-ground radiating area 121 is formed and surrounded by a first grounding conductor structure 1211, a second grounding conductor structure 1212 and the first edge 111. The width of the first edge 111 is w1. A first coupling distance d1 is formed between the first grounding conductor structure 1211 and the second grounding conductor structure 1212 such that the first no-ground radiating area 121 has a first breach 1213. The first feeding conductor portion 122 has a first coupling conductor structure 1221 and a first signal feeding conductor line 1222. The first coupling conductor structure 1221 is located in the first no-ground radiating area 121, the first coupling conductor structure 1221 is electrically coupled to or connected to a first signal source 1223 through the first signal feeding conductor line 1222, and the first signal source 1223 excites the first antenna 12 to generate at least one first resonant mode. The second antenna 13 comprises a second no-ground radiating area 131 and a second feeding conductor portion 132. The second no-ground radiating area 131 is formed and surrounded by a third grounding conductor structure 1311, a fourth grounding conductor structure 1312 and the second edge 112. The width of the second edge 112 is w2. A second coupling distance d2 is formed between the third grounding conductor structure 1311 and the fourth grounding conductor structure 1312 such that the second no-ground radiating area 131 has a second breach 1313. The second feeding conductor portion 132 has a second coupling conductor structure 1321 and a second signal feeding conductor line 1322. The second coupling conductor structure 1321 is located in the second no-ground radiating area 131. The second coupling conductor structure 1321 is electrically coupled to or connected to a second signal source 1323 through the second signal feeding conductor line 1322. The second signal source 1323 excites the second antenna 13 to generate at least one second resonant mode, and the first resonant mode and the second resonant mode cover at least one common communication system band.

The first antenna 12 and the second antenna 13 of the antenna array 1 is designed to have a specific grounding conductor structures to form the first no-ground radiating area 121 and the second no-ground radiating area 131, and effectively excite the first no-ground radiating area 121 and the second no-ground radiating area 131 to generate radiating energy by designing the first feeding conductor portion 122 and the second feeding conductor portion 132. In this way, the excited current would be mainly constrained around the first no-ground radiating area 121 and the second no-ground radiating area 131. Thereby the correlation coefficient between the first antenna 12 and the second antenna 13 could be effectively reduced to enhance the antenna radiation efficiency. The first no-ground radiating area 121 and the second no-ground radiating area 131 designed by the antenna array 1 respectively have the first breach 1213 and the second breach 1313. The impedance matching level of resonant modes excited by the first antenna 12 and the second antenna 13 could be improved by adjusting the first coupling distance d1 and the second coupling distance d2 and the areas of the first no-ground radiating area 121 and the second no-ground radiating area 131. The areas of the first no-ground radiating area 121 and the second no-ground radiating area 131 are both less than the square of 0.19 wavelength ($(0.19\lambda)^2$) of the lowest operating frequency of the at least one common communication system band covered by the first antenna 12 and the second antenna 13. The first coupling distance d1 and the second coupling distance d2 are both less than or equal to 0.059 wavelength of the lowest operating frequency of the at least one common communication system band covered by the first antenna 12 and the second antenna 13.

The antenna array 1 adjusts the distance d3 between the center position of the first breach 1213 and the center position of the second breach 1313 which could effectively reduce the required width w1 and width w2 of the first edge 111 and the second edge 112 and thereby reduce the quality factor of the antenna array to enhance the antenna radiation characteristics. The required width w1 and width w2 of the first edge 111 and the second edge 112 are both less than or equal to 0.21 wavelength of the lowest operating frequency of the at least one common communication system band covered by the first antenna 12 and the second antenna 13. In addition, the antenna array 1 could guide the antenna radiation pattern by adjusting the coupling distances d1 and d2 and adjusting the distance d3 between the center position of the first breach 1213 and the center position of the second breach 1313, and thereby reduce the energy coupling level between the first antenna 12 and the second antenna 13. The distance d3 between the center position of the first breach 1213 and the center position of the second breach 1313 is between 0.09 wavelength and 0.46 wavelength of the lowest operating frequency of the at least one common communication system band covered by the first antenna 12 and the second antenna 13.

Figure 2:
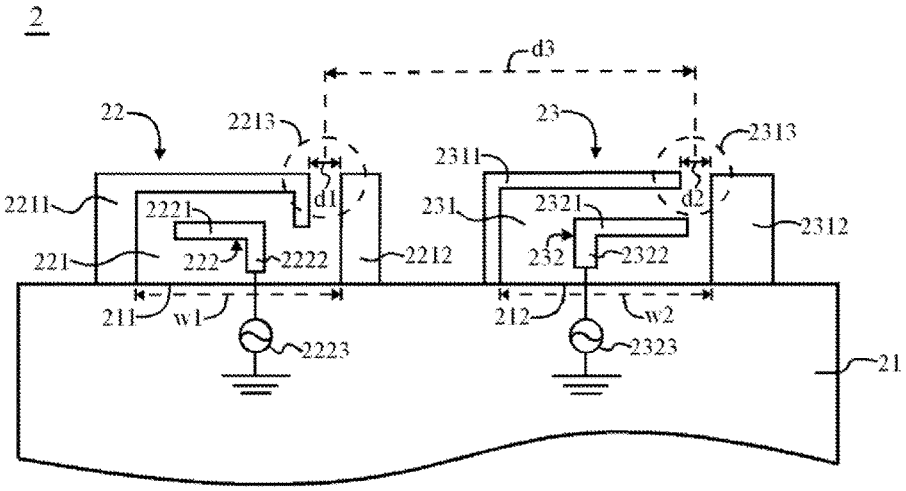
FIG. 2 shows a structural diagram of an antenna array 2 according to an embodiment of the present disclosure.

FIG. 2 shows a structural diagram of an antenna array 2 according to an embodiment of the present disclosure. As shown in FIG. 2, the antenna array 2 comprises a ground conductor portion 21, a first antenna 22, and a second antenna 23. The ground conductor portion 21 has at least one first edge 211 and a second edge 212. The first antenna 22 comprises a first no-ground radiating area 221 and a first feeding conductor portion 222. The first no-ground radiating area 221 is formed and surrounded by a first grounding conductor structure 2211, a second grounding conductor structure 2212 and the first edge 211. The width of the first edge 211 is w1. The first grounding conductor structure 2211 and the second grounding conductor structure 2212 are electrically connected to the ground conductor portion 21 and adjacent to the first edge 211. A first coupling distance d1 is formed between the first grounding conductor structure 2211 and the second grounding conductor structure 2212 such that the first no-ground radiating area 221 has a first breach 2213. The first feeding conductor portion 222 has a first coupling conductor structure 2221 and a first signal feeding conductor line 2222. The first coupling conductor structure 2221 is located in the first no-ground radiating area 221, the first coupling conductor structure 2221 is electrically coupled to or connected to a first signal source 2223 through the first signal feeding conductor line 2222, and the first signal source 2223 excites the first antenna 22 to generate at least one first resonant mode. The second antenna 23 comprises a second no-ground radiating area 231 and a second feeding conductor portion 232. The second no-ground radiating area 231 is formed and surrounded by a third grounding conductor structure 2311, a fourth grounding conductor structure 2312 and the second edge 212. The width of the second edge 212 is w2. The third grounding conductor structure 2311 and the fourth grounding conductor structure 2312 are electrically connected to the ground conductor portion 21 and adjacent to the second edge 212. A second coupling distance d2 is formed between the third grounding conductor structure 2311 and the fourth grounding conductor structure 2312 such that the second no-ground radiating area 231 has a second breach 2313. The second feeding conductor portion 232 has a second coupling conductor structure 2321 and a second signal feeding conductor line 2322. The second coupling conductor structure 2321 is located in the second no-ground radiating area 231. The second coupling conductor structure 2321 is electrically coupled to or connected to a second signal source 2323 through the second signal feeding conductor line 2322. The second signal source 2323 excites the second antenna 23 to generate at least one second resonant mode, and the first resonant mode and the second resonant mode cover at least one common communication system band.

The first antenna 22 and the second antenna 23 of the antenna array 2 is designed to have specific grounding conductor structures to form the first no-ground radiating area 221 and the second no-ground radiating area 231, and to effectively trigger the first no-ground radiating area 221 and the second no-ground radiating area 231 to generate radiating energy by designing the first feeding conductor portion 222 and the second feeding conductor portion 232. In this way, the triggered current would be mainly constrained around the first no-ground radiating area 221 and the second no-ground radiating area 231. Thereby the correlation coefficient between the first antenna 22 and the second antenna 23 could be effectively reduced to enhance the antenna radiation efficiency. The first no-ground radiating area 221 and the second no-ground radiating area 231 designed by the antenna array 2 respectively have the first breach 2213 and the second breach 2313. The impedance matching of resonant modes triggered by the first antenna 22 and the second antenna 23 could be improved by adjusting the first coupling distance d1 and the second coupling distance d2 and the areas of the first no-ground radiating area 221 and the second no-ground radiating area 231. The areas of the first no-ground radiating area 221 and the second no-ground radiating area 231 are both less than the square of 0.19 wavelength ($(0.19\lambda)^2$) of the lowest operating frequency of the at least one common communication system band covered by the first antenna 22 and the second antenna 23. The first coupling distance d1 and the second coupling distance d2 are both less than or equal to 0.059 wavelength of the lowest operating frequency of the at least one common communication system band covered by the first antenna 22 and the second antenna 23.

The antenna array 2 adjusts the distance d3 between the center position of the first breach 2213 and the center position of the second breach 2313 which could effectively reduce the required width w1 and width w2 of the first edge 211 and the second edge 212 and thereby reduce the quality factor of the antenna array to enhance the antenna radiation characteristics. The required width w1 and width w2 of the first edge 211 and the second edge 212 are both less than or equal to 0.21 wavelength of the lowest operating frequency of the at least one common communication system band covered by the first antenna 22 and the second antenna 23. In addition, the antenna array 2 could guide the antenna radiation pattern by adjusting the coupling distances d1 and d2 and adjusting the distance d3 between the center position of the first breach 2213 and the center position of the second breach 2313, and thereby reduce the energy coupling level between the first antenna 22 and the second antenna 23. The distance d3 between the center position of the first breach 2213 and the center position of the second breach 2313 is between 0.09 wavelength and 0.46 wavelength of the lowest operating frequency of the at least one common communication system band covered by the first antenna 22 and the second antenna 23.

Compared to the antenna array 1, although the shapes of the first and second grounding conductor structures 2211, 2212 and the third and fourth grounding conductor structures 2311, 2312 of the antenna array 2 are different from the antenna array 1, and the first and second feeding conductor portion 222, 232 of the antenna array 2 are also different from the antenna array 1, the antenna array 2 still forms the first no-ground radiating area 221 and the second no-ground radiating area 231 by designing specific grounding conductor structures. The antenna array 2 also respectively and effectively excites the first no-ground radiating area 221 and the second no-ground radiating area 231 to generate radiating energy by designing the first feeding conductor portion 222 and the second feeding conductor portion 232. The antenna array 2 also improves the impedance matching of resonant modes generated by the first antenna 22 and the second antenna 23 by adjusting the first coupling distance d1 and the second coupling distance d2 and the areas of the first no-ground radiating area 221 and the second no-ground radiating area 231. The antenna array 2 also adjusts the distance d3 between the center position of the first breach 2213 and the center position of the second breach 2313 to reduce the width w1 of the first edge 211 and the width w2 of the second edge 212. The antenna array 2 also guides the antenna radiating pattern to reduce the energy coupling level between the first antenna 12 and the second antenna 13. Therefore the antenna array 2 could achieve radiation characteristics that are similar to those of the first antenna array 1.

Figure 3A:
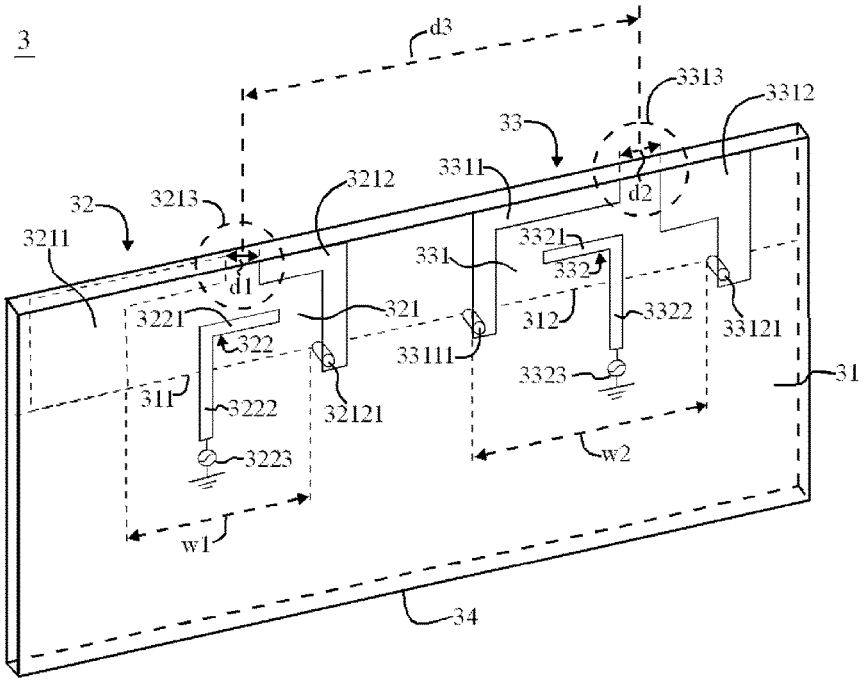
FIG. 3A shows a structural diagram of an antenna array 3 according to an embodiment of the present disclosure.
Figure 3B:
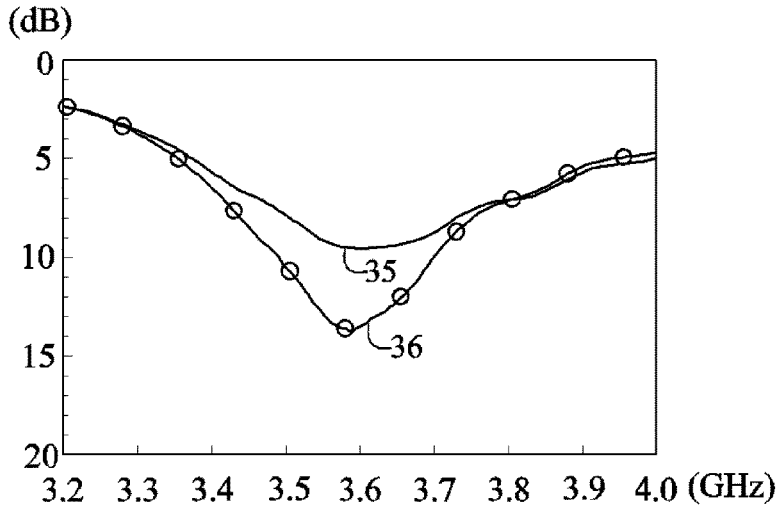
FIG. 3B shows a graph of measured return loss of the antenna array 3 according to an embodiment of the present disclosure.

FIG. 3A shows a structural diagram of an antenna array 3 according to an embodiment of the present disclosure. As shown in FIG. 3A, the antenna array 3 is disposed on a substrate 34 and comprises a ground conductor portion 31, a first antenna 32, and a second antenna 33. The substrate 34 could be a system circuit board, a printed circuit board or a flexible printed circuit board of a communication device. The ground conductor portion 31 is located on the back surface of the substrate 34, and has at least one first edge 311 and a second edge 312. The first antenna 32 comprises a first no-ground radiating area 321 and a first feeding conductor portion 322. The first no-ground radiating area 321 is formed and surrounded by a first grounding conductor structure 3211, a second grounding conductor structure 3212 and the first edge 311. The width of the first edge 311 is w1. The first grounding conductor structure 3211 and the second grounding conductor structure 3212 are both electrically connected to the ground conductor portion 31 and adjacent to the first edge 311. A first coupling distance d1 is formed between the first grounding conductor structure 3211 and the second grounding conductor structure 3212 such that the first no-ground radiating area 321 has a first breach 3213. The first grounding conductor structure 3211 is located on the back surface of the substrate 34, and the second grounding conductor structure 3212 is located on the front surface of the substrate 34. The second grounding conductor structure 3212 is electrically connected to the ground conductor portion 31 through a via-hole conducting structure 32121. The first feeding conductor portion 322 has a first coupling conductor structure 3221 and a first signal feeding conductor line 3222. The first coupling conductor structure 3221 is located in the first no-ground radiating area 321, the first coupling conductor structure 3221 is electrically coupled to or connected to a first signal source 3223 through the first signal feeding conductor line 3222, and the first signal source 3223 excites the first antenna 32 to generate at least one first resonant mode 35 (as shown in FIG. 3B). The second antenna 33 comprises a second no-ground radiating area 331 and a second feeding conductor portion 332. The second no-ground radiating area 331 is formed and surrounded by a third grounding conductor structure 3311, a fourth grounding conductor structure 3312 and the second edge 312. The width of the second edge 312 is w2. The third grounding conductor structure 3311 and the fourth grounding conductor structure 3312 are both electrically connected to the ground conductor portion 31 and adjacent to the second edge 312. A second coupling distance d2 is formed between the third grounding conductor structure 3311 and the fourth grounding conductor structure 3312 such that the second no-ground radiating area 331 has a second breach 3313. The third grounding conductor structure 3311 and the fourth grounding conductor structure 3312 are both located on the front surface of the substrate 34, the third grounding conductor structure 3311 is electrically connected to the ground conductor portion 31 through a via-hole conducting structure 33111, and the fourth grounding conductor structure 3312 is electrically connected to the ground conductor portion 31 through a via-hole conducting structure 33121. The second feeding conductor portion 332 has a second coupling conductor structure 3321 and a second signal feeding conductor line 3322. The second coupling conductor structure 3321 is located in the second no-ground radiating area 331. The second coupling conductor structure 3321 is electrically coupled to or connected to a second signal source 3323 through the second signal feeding conductor line 3322. The second signal source 3323 excites the second antenna 33 to generate at least one second resonant mode 36 (as shown in FIG. 3B), and the first and second resonant modes 35, 36 cover at least one common communication system band.

The first antenna 32 and the second antenna 33 of the antenna array 3 is designed to have specific grounding conductor structures to form the first no-ground radiating area 321 and the second no-ground radiating area 331, and to effectively excite the first no-ground radiating area 321 and the second no-ground radiating area 331 to generate radiating energy by designing the first feeding conductor portion 322 and the second feeding conductor portion 232. In this way, the excited current is mainly constrained around the first no-ground radiating area 321 and the second no-ground radiating area 331. Thereby the correlation coefficient between the first antenna 32 and the second antenna 33 could be effectively reduced to enhance the antenna radiation efficiency. The first no-ground radiating area 321 and the second no-ground radiating area 331 designed by the antenna array 3 respectively have the first breach 3213 and the second breach 3313. The impedance matching of resonant modes generated by the first antenna 32 and the second antenna 33 could be improved by adjusting the first coupling distance d1 and the second coupling distance d2 and the areas of the first no-ground radiating area 321 and the second no-ground radiating area 331. The areas of the first no-ground radiating area 321 and the second no-ground radiating area 331 are both less than the square of 0.19 wavelength ($(0.19\lambda)^2$) of the lowest operating frequency of the at least one common communication system band covered by the first antenna 32 and the second antenna 33. The first coupling distance d1 and the second coupling distance d2 are both less than or equal to 0.059 wavelength of the lowest operating frequency of the at least one common communication system band covered by the first antenna 32 and the second antenna 33.

The antenna array 3 adjusts the distance d3 between the center position of the first breach 3213 and a center position of the second breach 3313 which could effectively reduce the required width w1 and width w2 of the first edge 311 and the second edge 312 and thereby reduce the quality factor of the antenna array to enhance the antenna radiation characteristics. The required width w1 and width w2 of the first edge 311 and the second edge 312 are both less than or equal to 0.21 wavelength of the lowest operating frequency of the at least one common communication system band covered by the first antenna 32 and the second antenna 33. In addition, the antenna array 3 could guide the antenna radiation pattern by adjusting the coupling distances d1 and d2 and adjusting the distance d3 between the center position of the first breach 3213 and the center position of the second breach 3313, and thereby reduce the energy coupling level between the first antenna 32 and the second antenna 33. The distance d3 between the center position of the first breach 3213 and the center position of the second breach 3313 is between 0.09 wavelength and 0.46 wavelength of the lowest operating frequency of the at least one common communication system band covered by the first antenna 32 and the second antenna 33.

Compared to the antenna array 1, although the antenna array 3 is formed on the substrate 34, and the shapes of the grounding conductor structures and the feeding conductor portions of the antenna array 3 are different from the antenna array 1, the antenna array 3 still forms the first no-ground radiating area 321 and the second no-ground radiating area 331 by designing specific grounding conductor structures. The antenna array 3 also respectively and effectively triggers the first no-ground radiating area 321 and the second no-ground radiating area 331 to generate radiation energy by designing the first feeding conductor portion 322 and the second feeding conductor portion 332. The antenna array 3 also improves the impedance matching of resonant modes excited by the first antenna 32 and the second antenna 33 by adjusting the first coupling distance d1 and the second coupling distance d2 and the areas of the first no-ground radiating area 321 and the second no-ground radiating area 331, the antenna array 3 also adjusts the distance d3 between the center position of the first breach 3213 and the center position of the second breach 3313 to reduce the width w1 of the first edge 311 and the width w2 of the second edge 312, and the antenna array 3 also guides the antenna radiating pattern to reduce the energy coupling level between the first antenna 32 and the second antenna 33. Therefore the antenna array 3 could also achieve performances that are similar to those of the first antenna array 1.

Figure 3C:
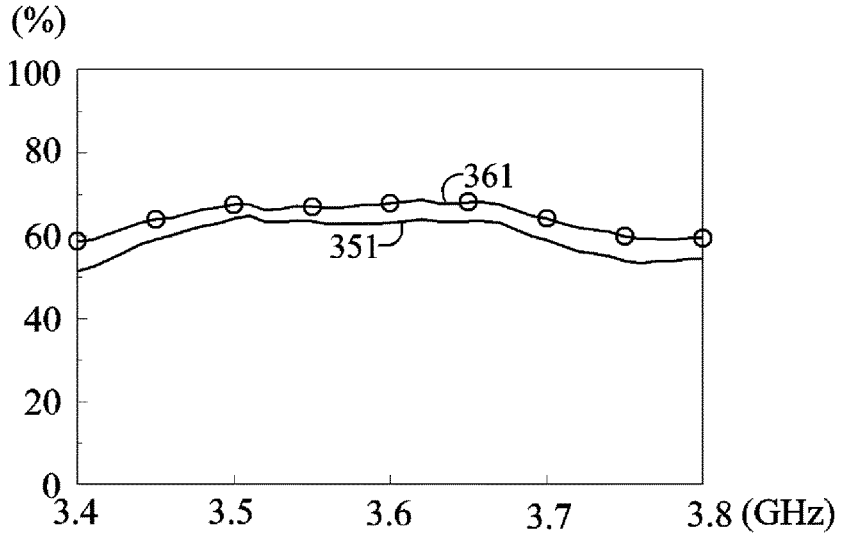
FIG. 3C shows a graph of measured radiation efficiency of the antenna array 3 according to an embodiment of the present disclosure.
Figure 3D:
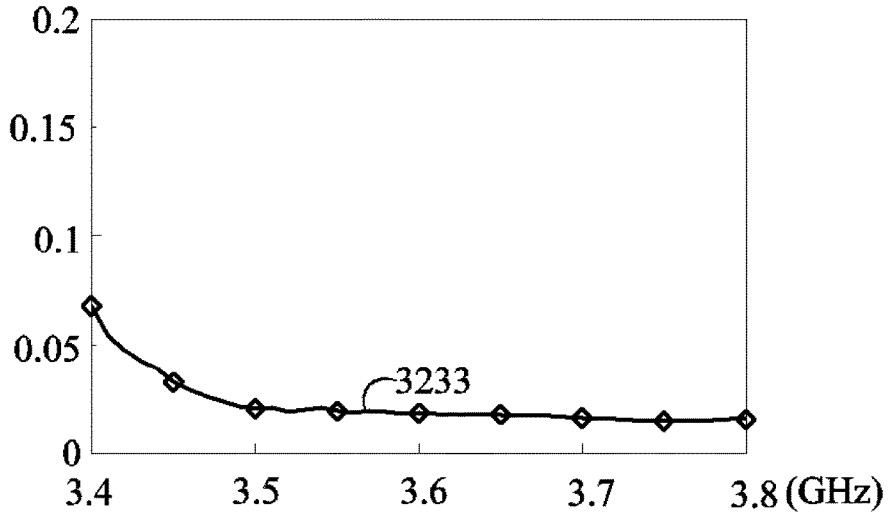
FIG. 3D shows a graph of measured envelope correlation coefficient (ECC) of the antenna array 3 according to an embodiment of the present disclosure.

FIG. 3B shows a graph of measured return loss of the antenna array 3 shown in FIG. 3A. The following sizes and parameters were chosen for conducting experiments: the thickness of the substrate 34 is about 1 mm; the area of the first no-ground radiating area 321 is about 63 $mm^2$; the area of the second no-ground radiating area 331 is about 69 $mm^2$; the first coupling distance d1 is about 1.9 mm; the second coupling distance d2 is about 1.6 mm; the width w1 of the first edge 311 is about 9 mm; the width w2 of the second edge 312 is about 9.8 mm; the distance d3 between the center position of the first breach 3213 and the center position of the second breach 3313 is about 23 mm. As shown in FIG. 3B, the first antenna 32 generates a first resonant mode 35, and the second antenna 33 generates a second resonant mode 36. In the present embodiment, the first resonant mode 35 and the second resonant mode 36 cover a common communication system band of 3.6 GHz. The lowest operating frequency of the communication system band of 3.6 GHz is 3.3 GHz. FIG. 3C shows a graph of measured radiation efficiency of the antenna array 3. As shown in FIG. 3C, the values of a radiation efficiency curve 351 of the first resonant mode 35 generated by the first antenna 32 are all higher than 50%, and the values of a radiation efficiency curve 361 of the second resonant mode 36 generated by the second antenna 36 are all higher than 60%. FIG. 3D shows a graph of measured envelope correlation coefficient (ECC) of the antenna array 3. As shown in FIG. 3D, the values of an envelope correlation coefficient curve 3233 of the first antenna 32 and the second antenna 33 are all less than 0.1.

The experimental data shown and the communication system band covered in FIG. 3B, FIG. 3C and FIG. 3D are only used to experimentally prove the technical efficacy of the antenna array 3 of an embodiment of the present disclosure in FIG. 3A, but not used to limit the communication system bands, applications and standards covered by the antenna array of the present disclosure in practical applications. The antenna array of the present disclosure could be designed to use in the communication system bands of Wireless Wide Area Network (WWAN) System, Long Term Evolution (LTE) System, Wireless Personal Network (WLPN) System, Wireless Local Area Network (WLAN) System, Near Field Communication (NFC) System, Digital Television Broadcasting System (DTV), Global Positioning System (GPS), Multi-Input Multi-Output (MIMO) System, Pattern Switchable System, or Beam-Steering/Beam-Forming Antenna System.

Figure 4:
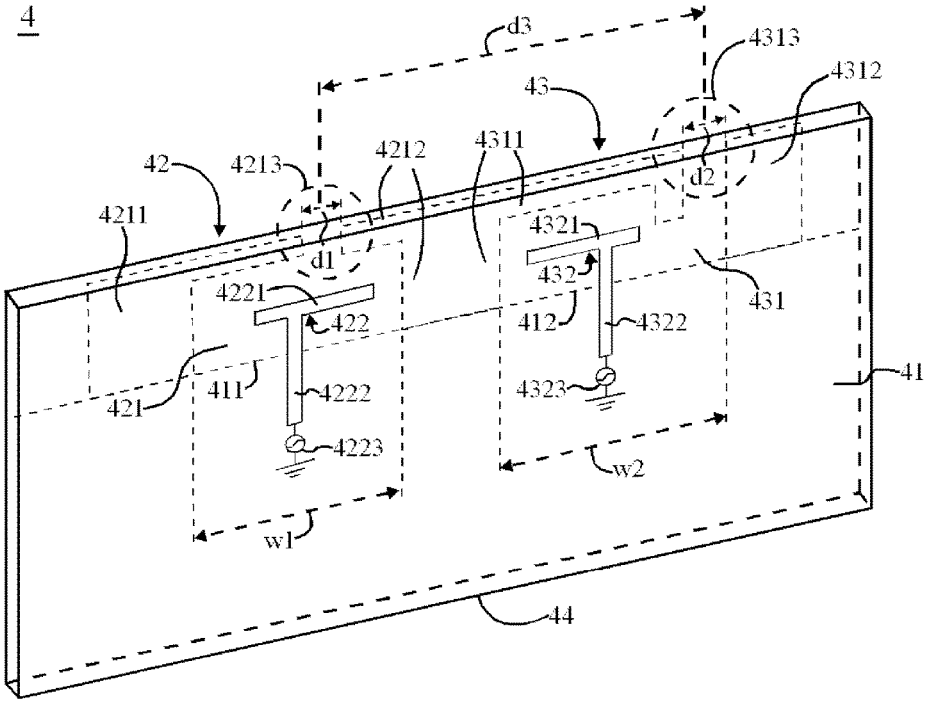
FIG. 4 shows a structural diagram of an antenna array 4 according to an embodiment of the present disclosure.

FIG. 4 shows a structural diagram of an antenna array 4 according to an embodiment of the present disclosure. As shown in FIG. 4, the antenna array 4 is disposed on a substrate 44 and comprises a ground conductor portion 41, a first antenna 42, and a second antenna 43. The substrate 44 could be a system circuit board, a printed circuit board or a flexible printed circuit board of a communication device. The ground conductor portion 41 is located on the back surface of the substrate 44, and has at least one first edge 411 and a second edge 412. The first antenna 42 comprises a first no-ground radiating area 421 and a first feeding conductor portion 422. The first no-ground radiating area 421 is formed and surrounded by a first grounding conductor structure 4211, a second grounding conductor structure 4212 and the first edge 411. The width of the first edge 411 is w1. The first grounding conductor structure 4211 and the second grounding conductor structure 4212 are both electrically connected to the ground conductor portion 41 and adjacent to the first edge 411. A first coupling distance d1 is formed between the first grounding conductor structure 4211 and the second grounding conductor structure 4212 such that the first no-ground radiating area 421 has a first breach 4213. The first grounding conductor structure 4211 and the second grounding conductor structure 4212 are both located on the back surface of the substrate 44, and the first feeding conductor portion 422 is located on the front surface of the substrate 34. The first feeding conductor portion 422 has a first coupling conductor structure 4221 and a first signal feeding conductor line 4222. The first coupling conductor structure 4221 is located in the first no-ground radiating area 421, the first coupling conductor structure 4221 is electrically coupled to or connected to a first signal source 4223 through the first signal feeding conductor line 4222, and the first signal source 4223 excites the first antenna 42 to generate at least one first resonant mode. The second antenna 43 comprises a second no-ground radiating area 431 and a second feeding conductor portion 432. The second no-ground radiating area 431 is formed and surrounded by a third grounding conductor structure 4311, a fourth grounding conductor structure 4312 and the second edge 412. The width of the second edge 412 is w2. The third grounding conductor structure 4311 and the fourth grounding conductor structure 4312 are both electrically connected to the ground conductor portion 41 and adjacent to the second edge 412. A second coupling distance d2 is formed between the third grounding conductor structure 4311 and the fourth grounding conductor structure 4312 such that the second no-ground radiating area 431 has a second breach 4313. The third grounding conductor structure 4311 and the fourth grounding conductor structure 4312 are both located on the back surface of the substrate 44. The second feeding conductor portion 432 is located on the front surface of the substrate 44, and has a second coupling conductor structure 4321 and a second signal feeding conductor line 4322. The second coupling conductor structure 4321 is located in the second no-ground radiating area 431. The second coupling conductor structure 4321 is electrically coupled to or connected to a second signal source 4323 through the second signal feeding conductor line 4322. The second signal source 4323 excites the second antenna 43 to generate at least one second resonant mode, and the first and second resonant modes cover at least one common communication system band.

The first antenna 42 and the second antenna 43 of the antenna array 4 is designed to have specific grounding conductor structures to form the first no-ground radiating area 421 and the second no-ground radiating area 431, and to effectively trigger the first no-ground radiating area 421 and the second no-ground radiating area 431 to generate radiating energy by designing the first feeding conductor portion 422 and the second feeding conductor portion 432. In this way, the triggered current would be mainly constrained around the first no-ground radiating area 421 and the second no-ground radiating area 431. Thereby the envelope correlation coefficient between the first antenna 42 and the second antenna 43 could be effectively reduced to enhance the antenna radiation efficiency. The first no-ground radiating area 421 and the second no-ground radiating area 431 designed by the antenna array 4 respectively have the first breach 4213 and the second breach 4313. The impedance matching level of resonant modes excited by the first antenna 42 and the second antenna 43 could be improved by adjusting the first coupling distance d1 and the second coupling distance d2 and the areas of the first no-ground radiating area 421 and the second no-ground radiating area 431. The areas of the first no-ground radiating area 421 and the second no-ground radiating area 431 are both less than the square of 0.19 wavelength ($(0.19\lambda)^2$) of the lowest operating frequency of the at least one common communication system band covered by the first antenna 42 and the second antenna 43. The first coupling distance d1 and the second coupling distance d2 are both less than or equal to 0.059 wavelength of the lowest operating frequency of the at least one common communication system band covered by the first antenna 32 and the second antenna 33.

The antenna array 4 adjusts the distance d3 between the center position of the first breach 4213 and the center position of the second breach 4313 which could effectively reduce the required width w1 and width w2 of the first edge 411 and the second edge 412 and thereby reduce the quality factor of the antenna array to enhance the antenna radiation characteristics. The required width w1 and width w2 of the first edge 411 and the second edge 412 are both less than or equal to 0.21 wavelength of the lowest operating frequency of at least one common communication system band covered by the first antenna 42 and the second antenna 43. In addition, the antenna array 4 could guide the antenna radiating pattern by adjusting the coupling distances d1 and d2 and adjusting the distance d3 between the center position of the first breach 4213 and the center position of the second breach 4313, and thereby reduce the energy coupling level between the first antenna 42 and the second antenna 43. The distance d3 between the center position of the first breach 4213 and the center position of the second breach 4313 is between 0.09 wavelength and 0.46 wavelength of the lowest operating frequency of the at least one common communication system band covered by the first antenna 42 and the second antenna 43.

Compared to the antenna array 1, although the antenna array 4 is formed on the substrate 44, and the shapes of the grounding conductor structures and the feeding conductor portions of the antenna array 4 are different from those of the antenna array 1, the antenna array 4 still forms the first no-ground radiating area 421 and the second no-ground radiating area 431 by designing specific grounding conductor structures, and the antenna array 4 also respectively and effectively excites the first no-ground radiating area 421 and the second no-ground radiating area 431 to generate radiating energy by designing the first feeding conductor portion 422 and the second feeding conductor portion 432. The antenna array 4 also improves the impedance matching level of resonant modes generated by the first antenna 42 and the second antenna 43 by adjusting the first coupling distance d1 and the second coupling distance d2 and the areas of the first no-ground radiating area 421 and the second no-ground radiating area 431, the antenna array 4 also adjusts the distance d3 between the center position of the first breach 4213 and the center position of the second breach 4313 to reduce the width w1 of the first edge 411 and the width w2 of the second edge 412, and the antenna array 4 also guides the antenna radiating pattern to reduce the energy coupling level between the first antenna 42 and the second antenna 43. Therefore the antenna array 4 could achieve radiation performances that are similar to those of the first antenna array 1.

Figure 5A:
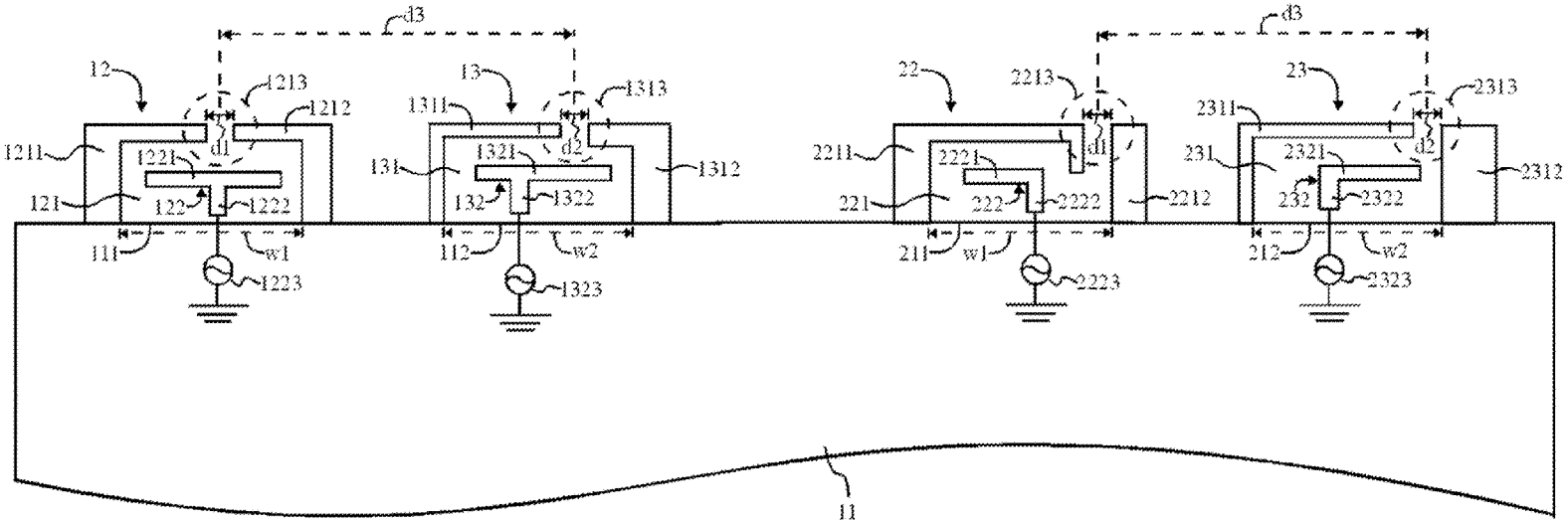
FIG. 5A shows a structural diagram for simultaneously implementing disclosed antenna array 1 and disclosed antenna array 2.
Figure 5B:
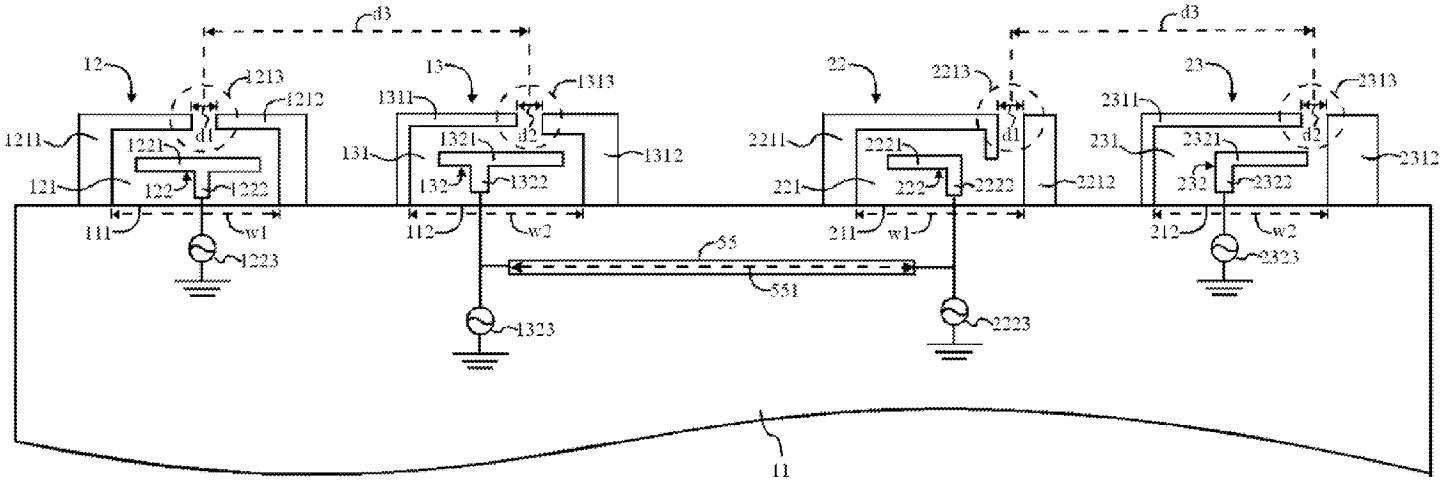
FIG. 5B shows a structural diagram for simultaneously implementing two disclosed antenna arrays 1.

The antenna arrays of multiple exemplary embodiments disclosed in the present disclosure could be applied in various kinds of communication devices. For example, a mobile communication device, a wireless communication device, a mobile computation device, a computer system, or communication equipment, network equipment, a computer device, network peripheral equipment, or computer peripheral equipment. In practical applications, embodiments of one or multiple antenna arrays provided by the present disclosure could be simultaneously configured or implemented in the communication device. FIG. 5A and FIG. 5B show a structural diagram for simultaneously implementing two antenna arrays disclosed by the present disclosure in a communication device. Refer to FIG. 5A, in the present embodiment, a structural diagram for simultaneously implementing disclosed antenna array 1 and disclosed antenna array 2 into same communication device is presented. Also refer to FIG. 5B, in the present embodiment, a structural diagram for simultaneously implementing two antenna arrays 1 of the present disclosure into same communication device is presented. In addition, in FIG. 5B, a connecting conductor line 55 is provided between the first signal source 1223 of the antenna array 1 at left side and the second signal source 1323 of the other antenna array 1 at the right side. A length of path 551 of the connecting conductor line 55 is between ⅕ wavelength and ½ wavelength of the lowest operating frequency of the at least one common communication system band covered by the first antenna 12 and the second antenna 13. The connecting conductor line 55 is used to adjust impedance matching and energy coupling between adjacent antenna arrays.

Figure 6:
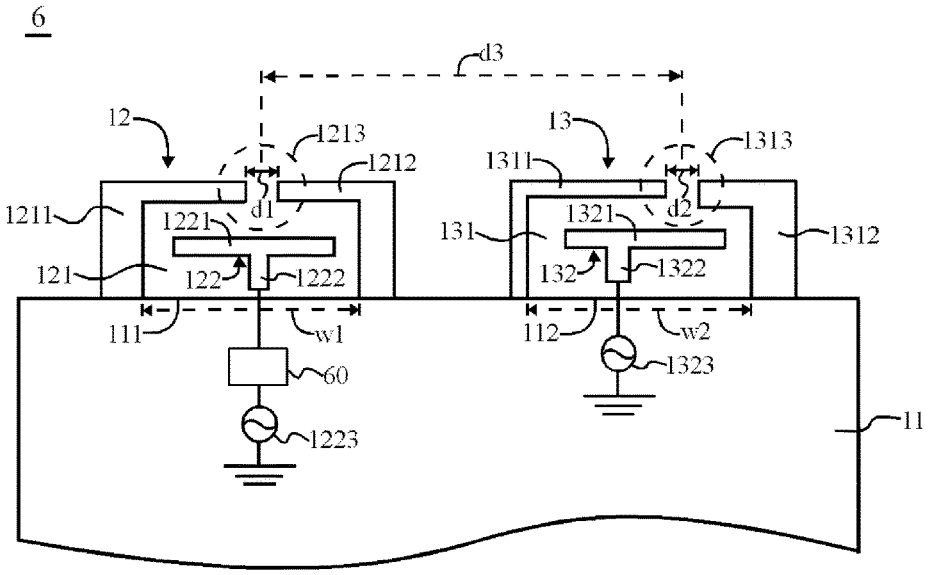
FIG. 6 shows a structural diagram of an antenna array 6 according to an embodiment of the present disclosure.

FIG. 6 shows a structural diagram of an antenna array 6 according to an embodiment of the present disclosure. The main difference between the antenna array 6 and the antenna array 1 is that a matching circuit 60 is provided between the first signal feeding conductor line 1222 and the first signal source 1223. The matching circuit 60 is used to adjust the impedance matching level of a resonant mode generated by the first antenna 12. Compared to the antenna array 1, although the antenna array 6 is further configured the matching circuit 60, but the antenna array 6 still could be designed to have specific grounding conductor structures form the first no-ground radiating area 121 and the second no-ground radiating area 131. The antenna array 6 also respectively and effectively triggers the first no-ground radiating area 121 and the second no-ground radiating area 131 to generate radiating energy by designing the first feeding conductor portion 122 and the second feeding conductor portion 132, the antenna array 6 also improves the impedance matching of resonant modes generated by the first antenna 12 and the second antenna 13 by adjusting the first coupling distance d1 and the second coupling distance d2 and the areas of the first no-ground radiating area 121 and the second no-ground radiating area 131, the antenna array 6 also adjusts the distance d3 between the center position of the first breach 1213 and the center position of the second breach 1313 to reduce the width w1 of the first edge 111 and the width w2 of the second edge 112, and the antenna array 6 also guides the antenna radiating pattern to reduce the energy coupling level between the first antenna 12 and the second antenna 13. Therefore the antenna array 6 could also achieve radiation characteristics that are similar to those of the first antenna array 1. Switching circuits, filter circuits, diplexer circuits, or circuits, elements, chips or modules consisting of capacitors, inductors, resistors and a transmission line could also be provided between the first signal feeding conductor line 1222 and the first signal source 1223 or provided between the second signal feeding conductor line 1322 and the second signal source 1323 and achieve similar antenna performance with the first antenna array 1.

Figure 7:
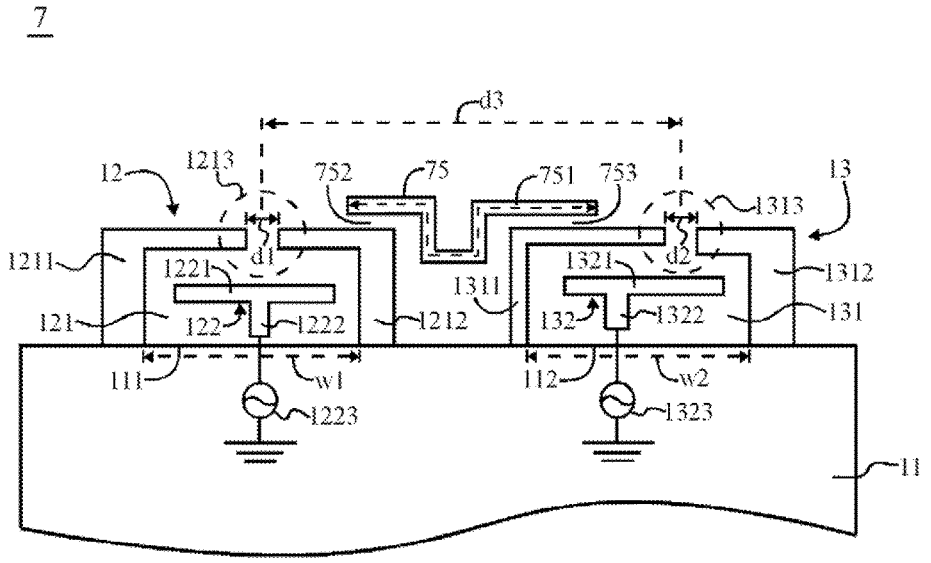
FIG. 7 shows a structural diagram of an antenna array 7 according to an embodiment of the present disclosure.

FIG. 7 shows a structural diagram of an antenna array 7 according to an embodiment of the present disclosure. The main difference between the antenna array 7 and the antenna array 1 is that a coupling conductor line 75 is provided between the first antenna 12 and the second antenna 13. A first coupling slit 752 is provided between the coupling conductor line 75 and the first antenna 12, and a second coupling slit 753 is provided between the coupling conductor line 75 and the second antenna 13. A length of path 751 of the coupling conductor line 75 is between ⅓ wavelength and ¾ wavelength of the lowest operating frequency of the at least one common communication system band covered by the first antenna 12 and the second antenna 13. The gap width of the first coupling slit 752 and the gap width of the second coupling slit 753 are both less than or equal to 0.063 wavelength of the lowest operating frequency of the at least one common communication system band covered by the first antenna 12 and the second antenna 13. The coupling conductor line 75 could be used to adjust the impedance matching and envelope correlation coefficient between the first antenna 12 and the second antenna 13.

Compared to the antenna array 1, although the antenna array 7 is further configured the coupling conductor line 75, but the antenna array 7 still could be designed to have specific grounding conductor structures to form the first no-ground radiating area 121 and the second no-ground radiating area 131. The antenna array 7 also respectively and effectively triggers the first no-ground radiating area 121 and the second no-ground radiating area 131 to generate radiating energy by designing the first feeding conductor portion 122 and the second feeding conductor portion 132, the antenna array 7 also improves the impedance matching of resonant modes excited by the first antenna 12 and the second antenna 13 by adjusting the first coupling distance d1 and the second coupling distance d2 and the areas of the first no-ground radiating area 121 and the second no-ground radiating area 131, the antenna array 7 also adjusts the distance d3 between the center position of the first breach 1213 and the center position of the second breach 1313 to reduce the width w1 of the first edge 111 and the width w2 of the second edge 112, and the antenna array 7 also guides the antenna radiating pattern to reduce the energy coupling level between the first antenna 12 and the second antenna 13. Therefore the antenna array 7 could also achieve antenna performances that are similar to those of the first antenna array 1.

Figure 8A:
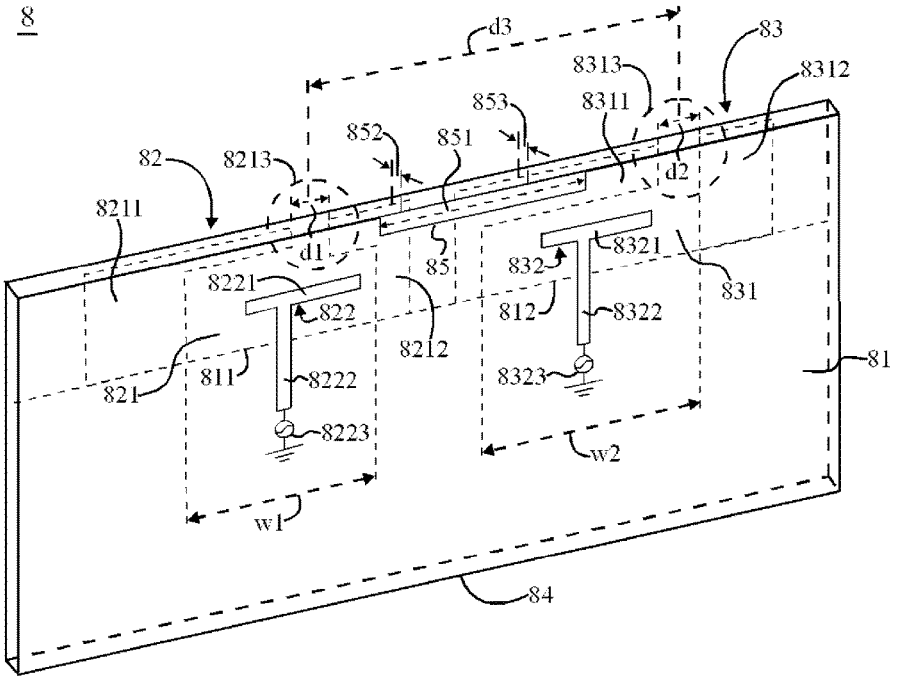
FIG. 8A shows a structural diagram of an antenna array 8 according to an embodiment of the present disclosure.

FIG. 8A shows a structural diagram of an antenna array 8 according to an embodiment of the present disclosure. As shown in FIG. 8A, the antenna array 8 is disposed on a substrate 84 and comprises a ground conductor portion 81, a first antenna 82, and a second antenna 83. The substrate 84 could be a system circuit board, a printed circuit board or a flexible printed circuit board of a communication device. The ground conductor portion 81 is located on the back surface of the substrate 84, and has at least one first edge 811 and a second edge 812. The first antenna 82 comprises a first no-ground radiating area 821 and a first feeding conductor portion 822. The first no-ground radiating area 821 is formed and surrounded by a first grounding conductor structure 8211, a second grounding conductor structure 8212 and the first edge 811. The width of the first edge 811 is w1. The first grounding conductor structure 8211 and the second grounding conductor structure 8212 are both electrically connected to the ground conductor portion 81 and adjacent to the first edge 811. A first coupling distance d1 is formed between the first grounding conductor structure 8211 and the second grounding conductor structure 8212 such that the first no-ground radiating area 821 has a first breach 8213. The first grounding conductor structure 8211 and the second grounding conductor structure 8212 are both located on the back surface of the substrate 84, and the first feeding conductor portion 822 is located on the front surface of the substrate 84. The first feeding conductor portion 822 has a first coupling conductor structure 8221 and a first signal feeding conductor line 8222. The first coupling conductor structure 8221 is located in the first no-ground radiating area 821, the first coupling conductor structure 8221 is electrically coupled to or connected to a first signal source 8223 through the first signal feeding conductor line 8222, and the first signal source 8223 excites the first antenna 82 to generate at least one first resonant mode. The second antenna 83 comprises a second no-ground radiating area 831 and a second feeding conductor portion 832. The second no-ground radiating area 831 is formed and surrounded by a third grounding conductor structure 8311, a fourth grounding conductor structure 8312 and the second edge 812. The width of the second edge 812 is w2. The third grounding conductor structure 8311 and the fourth grounding conductor structure 8312 are both electrically connected to the ground conductor portion 81 and adjacent to the second edge 812. A second coupling distance d2 is formed between the third grounding conductor structure 8311 and the fourth grounding conductor structure 8312 such that the second no-ground radiating area 831 has a second breach 8313. The third grounding conductor structure 8311 and the fourth grounding conductor structure 8312 are both located on the back surface of the substrate 84. The second feeding conductor portion 832 is located on the front surface of the substrate 84, and has a second coupling conductor structure 8321 and a second signal feeding conductor line 8322. The second coupling conductor structure 8321 is located in the second no-ground radiating area 831. The second coupling conductor structure 8321 is electrically coupled to or connected to a second signal source 8323 through the second signal feeding conductor line 8322. The second signal source 8323 excites the second antenna 83 to generate at least one second resonant mode, and the first and second resonant modes cover at least one common communication system band. As shown in FIG. 8A, a coupling conductor line 85 is configured between the first antenna 82 and the second antenna 83, and the coupling conductor line 85 is located on the front surface of the substrate 84. A first coupling slit 852 and a second coupling slit 853 are respectively provided between the coupling conductor line 85 and the first antenna 82 and between the coupling conductor line 85 and the second antenna 83. A length of path 851 of the coupling conductor line 85 is between ⅓ wavelength and ¾ wavelength of the lowest operating frequency of the at least one common communication system band covered by the first antenna 82 and the second antenna 83. The gap width of the first coupling slit 852 and the gap width of the second coupling slit 853 are both less than or equal to 0.063 wavelength of the lowest operating frequency of the at least one common communication system band covered by the first antenna 82 and the second antenna 83. The coupling conductor line 85 could be used to adjust the impedance matching and envelope correlation coefficient between the first antenna 82 and the second antenna 83.

The first antenna 82 and the second antenna 83 of the antenna array 8 is designed to have specific grounding conductor structures to form the first no-ground radiating area 821 and the second no-ground radiating area 831, and to effectively trigger the first no-ground radiating area 821 and the second no-ground radiating area 831 to generate radiating energy by designed the first feeding conductor portion 822 and the second feeding conductor portion 832. In this way, the excited current would be mainly constrained around the first no-ground radiating area 821 and the second no-ground radiating area 831. Thereby the envelope correlation coefficient between the first antenna 82 and the second antenna 83 could be effectively reduced to enhance the antenna radiation efficiency. The first no-ground radiating area 821 and the second no-ground radiating area 831 designed by the antenna array 8 respectively have the first breach 8213 and the second breach 8313. The impedance matching of resonant modes generated by the first antenna 82 and the second antenna 83 could be improved by adjusting the first coupling distance d1 and the second coupling distance d2 and the areas of the first no-ground radiating area 821 and the second no-ground radiating area 831. The areas of the first no-ground radiating area 821 and the second no-ground radiating area 831 are both less than the square of 0.19 wavelength ($(0.19\lambda)^2$) of the lowest operating frequency of the at least one common communication system band covered by the first antenna 82 and the second antenna 83. The first coupling distance d1 and the second coupling distance d2 are both less than or equal to 0.059 wavelength of the lowest operating frequency of the at least one common communication system band covered by the first antenna 82 and the second antenna 83.

The antenna array 8 adjusts the distance d3 between the center position of the first breach 8213 and the center position of the second breach 8313 which can effectively reduce the required width w1 and width w2 of the first edge 411 and the second edge 812 and thereby reduce the quality factor of the antenna array to enhance the antenna radiation characteristics. The required width w1 and width w2 of the first edge 811 and the second edge 812 are both less than or equal to 0.21 wavelength of the lowest operating frequency of the at least one common communication system band covered by the first antenna 82 and the second antenna 83. In addition, the antenna array 8 could guide the antenna radiating pattern by adjusting the coupling distances d1 and d2 and adjusting the distance d3 between the center position of the first breach 8213 and the center position of the second breach 8313, and thereby reduce the energy coupling level between the first antenna 82 and the second antenna 83. The distance d3 between the center position of the first breach 8213 and the center position of the second breach 8313 is between 0.09 wavelength and 0.46 wavelength of the lowest operating frequency of the at least one common communication system band covered by the first antenna 82 and the second antenna 83.

Compared to the antenna array 1, although the antenna array 8 is formed on the substrate 84, and the shapes of the grounding conductor structures and the feeding conductor portions of the antenna array 8 are different from the antenna array 1, and a coupling conductor line 85 is configured between the first antenna 82 and the second antenna 83, the antenna array 8 still forms the first no-ground radiating area 821 and the second no-ground radiating area 831 by designing specific grounding conductor structures. The antenna array 8 also respectively and effectively triggers the first no-ground radiating area 821 and the second no-ground radiating area 831 to generate radiation energy by designing the first feeding conductor portion 822 and the second feeding conductor portion 832. The antenna array 8 also improves the impedance matching of resonant modes triggered by the first antenna 82 and the second antenna 83 by adjusting the first coupling distance d1 and the second coupling distance d2 and the areas of the first no-ground radiating area 821 and the second no-ground radiating area 831. The antenna array 8 also adjusts the distance d3 between the center position of the first breach 8213 and the center position of the second breach 8313 to reduce the width w1 of the first edge 811 and the width w2 of the second edge 812. The antenna array 8 also guides the antenna radiation pattern to reduce the energy coupling between the first antenna 82 and the second antenna 83. Therefore the antenna array 8 could also achieve radiation performances that are similar to those of the first antenna array 1.

Figure 8B:
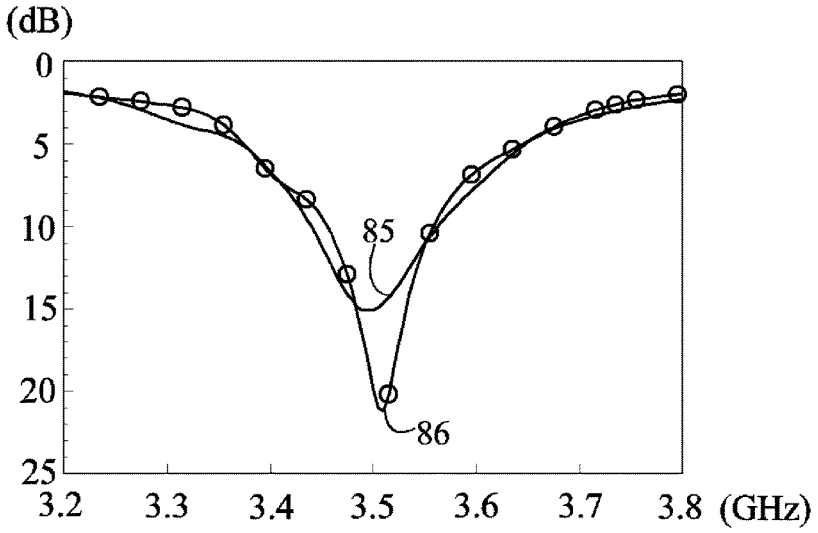
FIG. 8B shows a graph of measured return loss of the antenna array 8 according to an embodiment of the present disclosure.

FIG. 8B shows a graph of measured return loss of the antenna array 8 shown in FIG. 8A. The following sizes and parameters were chosen for conducting experiments: the thickness of the substrate 84 is about 0.8 mm; the area of the first no-ground radiating area 821 is about 59 $mm^2$; the area of the second no-ground radiating area 831 is about 69 $mm^2$; the first coupling distance d1 is about 1.6 mm; the second coupling distance d2 is about 1.3 mm; the width w1 of the first edge 811 is about 11 mm; the width w2 of the second edge 812 is about 13 mm; the distance d3 between the center position of the first breach 8213 and the center position of the second breach 8313 is about 29 mm. The length of path 851 of the coupling conductor line 85 is about 23 mm. Both the gap width of the first coupling slit 852 and the gap width of the second coupling slit 853 are about 0.8 mm. As shown in FIG. 8B, the first antenna 82 generates a first resonant mode 85, and the second antenna 83 generates a second resonant mode 86. In the present embodiment, the first resonant mode 85 and the second resonant mode 86 cover a common communication system band of 3.5 GHz. The lowest operating frequency of the communication system band 3.5 GHz is 3.3 GHz.

Figure 8C:
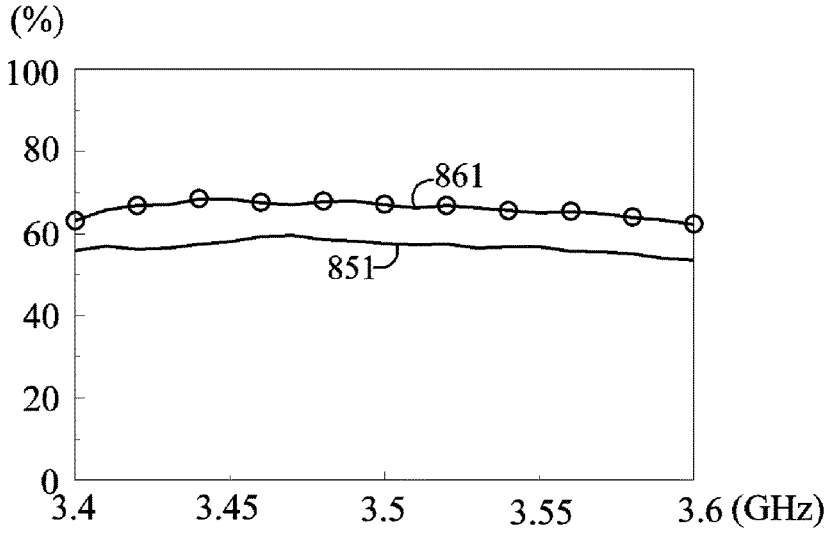
FIG. 8C shows a graph of measured radiation efficiency of the antenna array 8 according to an embodiment of the present disclosure.
Figure 8D:
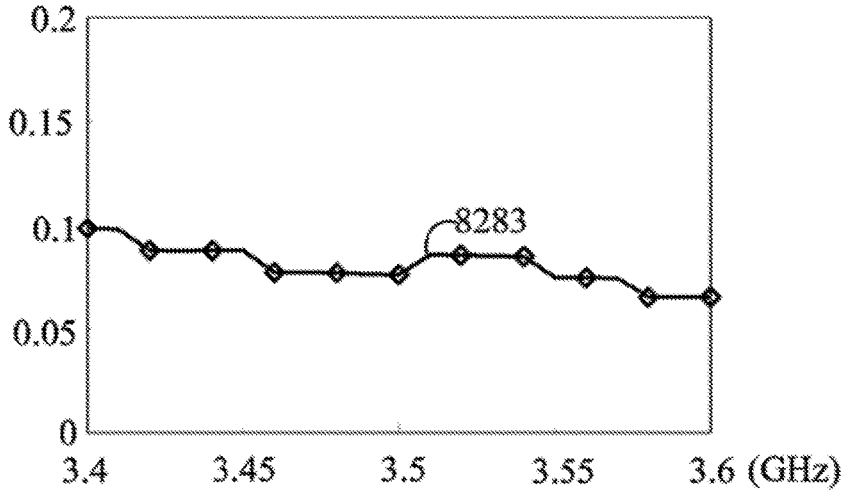
FIG. 8D shows a graph of measured envelope correlation coefficient (ECC) measurement of the antenna array 8 according to an embodiment of the present disclosure.

FIG. 8C shows a graph of measured radiation efficiency of the antenna array 8. As shown in FIG. 8C, the values of a radiation efficiency curve 851 of the first resonant mode 85 generated by the first antenna 82 are all higher than 53%, and the values of a radiation efficiency curve 861 of the second resonant mode 86 generated by the second antenna 86 are all higher than 63%. FIG. 8D shows a graph of measured envelope correlation coefficient (ECC) of the antenna array 8. As shown in FIG. 8D, the values of an envelope correlation coefficient curve 8233 of the first antenna 82 and the second antenna 83 are all less than 0.1.

The experimental data shown and the communication system band covered in FIG. 8B, FIG. 8C and FIG. 8D are only used to experimentally prove the technical efficacy of the antenna array 8 of an embodiment of the present disclosure in FIG. 8A, but not used to limit the communication system bands, applications and standards covered by the antenna array of the present disclosure in practical applications. The antenna array of the present disclosure could be designed to use in the communication system bands of Wireless Wide Area Network (WWAN) System, Long Term Evolution (LTE) System, Wireless Personal Network (WLPN) System, Wireless Local Area Network (WLAN) System, Near Field Communication (NFC) System, Digital Television Broadcasting System (DTV) System, Global Positioning System (GPS), Multi-Input Multi-Output (MIMO) System, Pattern Switchable Antenna System, or Beam-Steering/Beam-Forming Antenna System.

Figure 9:
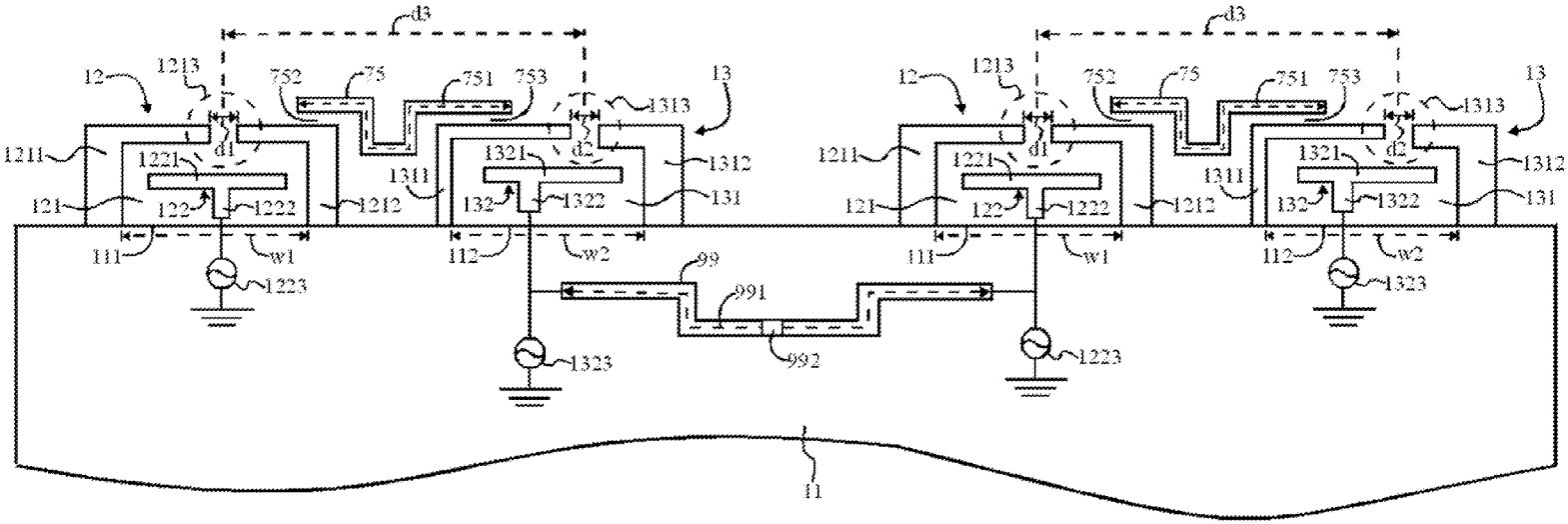
FIG. 9 shows a structural diagram for simultaneously implementing two disclosed antenna arrays 7.

The antenna arrays of multiple exemplary embodiments disclosed in the present disclosure could be applied in various kinds of communication devices. For example, a mobile communication device, a wireless communication device, a mobile computation device, a computer system, or communication equipment, network equipment, a computer device, network peripheral equipment, or computer peripheral equipment. In practical applications, embodiments of one or multiple antenna arrays provided by the present disclosure could be simultaneously configured or implemented in the communication devices. FIG. 9 shows a structural diagram for simultaneously implementing two antenna arrays of the present disclosure in a communication device. Refer to FIG. 9, in the present embodiment, a structural diagram for simultaneously implementing two disclosed antenna arrays 7 is presented. In addition, in FIG. 9, a connecting conductor line 99 is provided between the first signal source 1223 of the antenna array 7 and the second signal source 1323 of the other antenna array 7. A length of the path 991 of the connecting conductor line 99 is between ⅕ wavelength and ½ wavelength of the lowest operating frequency of the at least one common communication system band covered by the first antenna 12 and the second antenna 13, and the connecting conductor line 99 has an chip inductor 992. The connecting conductor line 99 and the chip inductor 992 are used to adjust impedance matching and energy coupling between adjacent antenna arrays. The connecting conductor line 99 also could be configured to have a chip capacitor. Although the embodiment of FIG. 9 configures two antenna arrays 7 in one communication device, but each antenna array 7 still could be designed to have specific grounding conductor structures to form the first no-ground radiating area 121 and the second no-ground radiating area 131. Each antenna array 7 also respectively and effectively triggers the first no-ground radiating area 121 and the second no-ground radiating area 131 to generate radiating energy by designing the first feeding conductor portion 122 and the second feeding conductor portion 132. Each antenna array 7 also improves the impedance matching of resonant modes generated by the first antenna 12 and the second antenna 13 by adjusting the first coupling distance d1 and the second coupling distance d2 and the areas of the first no-ground radiating area 121 and the second no-ground radiating area 131. Each antenna array 7 also adjusts the distance d3 between the center position of the first breach 1213 and the center position of the second breach 1313 to reduce the width w1 of the first edge 111 and the width w2 of the second edge 112, and each antenna array 7 also guides the antenna radiating pattern to reduce the energy coupling between the first antenna 12 and the second antenna 13. Therefore each of the two antenna arrays 7 of FIG. 9 could also achieve antenna performances that are similar to those of the first antenna array 1.

From the foregoing, the antennas of the antenna array of the embodiments of the present disclosure is designed to have specific grounding conductor structures to form no-ground radiating areas, and to effectively trigger the no-ground radiating areas to generate radiating energy by designing a feeding conductor portion. In this way, the excited current would be mainly constrained around the no-ground radiating area. Thereby the correlation coefficient between multiple antennas could be effectively reduced. The no-ground radiating area of the present disclosure is designed to have a breach. The impedance matching of resonant modes generated by the antennas could be improved by adjusting the coupling distance of the breach and the area of the no-ground radiating areas. In addition, adjusting the coupling distance of the breach and adjusting the distances between the breach and the breaches of other adjacent no-ground radiating areas could guide the antenna radiation pattern and thereby reduce the energy coupling between the antenna and adjacent antennas. Adjusting the distance between breaches of adjacent no-ground radiating areas could effectively reduce the required width of the no-ground radiating area and thereby reduce the quality factor of the antenna array to enhance the antenna radiation characteristics.

In summary, although the present disclosure is disclosed in the above embodiments, the present disclosure is not limited thereto. The following description is of the best-contemplated mode of carrying out the present disclosure. This description is made for the purpose of illustrating the general principles of the present disclosure and should not be taken in a limiting sense. Those skilled in the art should also realize that such equivalent constructions do not depart from the spirit and scope of the present disclosure, and that they may make various changes, substitutions, and alterations herein without departing from the spirit and scope of the present disclosure. Therefore the scope of the present disclosure is best determined by reference to the below appended claims.

What is claimed is:

1. An antenna array, comprising:

a ground conductor portion having at least one first edge and a second edge;

a first antenna, comprising:

a first no-ground radiating area formed and surrounded by a first grounding conductor structure, a second grounding conductor structure, and the first edge, wherein the first grounding conductor structure and the second grounding conductor structure are electrically connected to the ground conductor portion and adjacent to the first edge, and wherein a first coupling distance is formed between the first grounding conductor structure and the second grounding conductor structure such that the first no-ground radiating area has a first breach; and a first feeding conductor portion having a first coupling conductor structure and a first signal feeding conductor line, wherein the first coupling conductor structure is located in the first no-ground radiating area, the first coupling conductor structure is electrically coupled to or connected to a first signal source through the first signal feeding conductor line, and the first signal source excites the first antenna to generate at least one first resonant mode; and a second antenna, comprising:

a second no-ground radiating area formed and surrounded by a third grounding conductor structure, a fourth grounding conductor structure, and the second edge, wherein the third grounding conductor structure and the fourth grounding conductor structure are electrically connected to the ground conductor portion and adjacent to the second edge, and wherein a second coupling distance is formed between the third grounding conductor structure and the fourth grounding conductor structure such that the second no-ground radiating area has a second breach; and a second feeding conductor portion having a second coupling conductor structure and a second signal feeding conductor line, wherein the second coupling conductor structure is located in the second no-ground radiating area, the second coupling conductor structure is electrically coupled to or connected to a second signal source through the second signal feeding conductor line, the second signal source excites the second antenna to generate at least one second resonant mode, and the first resonant mode and the second resonant mode cover at least one common communication system band, wherein the area of the first no-ground radiating area and the area of the second no-ground radiating area are both less than a square of 0.19 wavelength of a lowest operating frequency of the at least one common communication system band covered by the first antenna and the second antenna.

2. The antenna array as claimed in claim 1, wherein the first coupling distance and the second coupling distance are both less than or equal to 0.059 wavelength of the lowest operating frequency of a at least one common communication system band covered by the first antenna and the second antenna.

3. The antenna array as claimed in claim 1, wherein a width of the first edge and a width of the second edge are both less than or equal to 0.21 wavelength of the lowest operating frequency of a at least one common communication system band covered by the first antenna and the second antenna.

4. The antenna array as claimed in claim 1, wherein a distance between a center position of the first breach and a center position of the second breach is between 0.09 wavelength and 0.46 wavelength of a lowest operating frequency of the at least one common communication system band covered by the first antenna and the second antenna.

5. The antenna array as claimed in claim 1, wherein the antenna array is provided on a substrate, and the substrate is a system circuit board, a printed circuit board or a flexible printed circuit board of a communication device.

6. The antenna array as claimed in claim 1, wherein one or a plurality of the antenna arrays are implemented in a communication device, and the communication device is a mobile communication device, a wireless communication device, a mobile computation device, a computer system, communication equipment, network equipment, a computer device, network peripheral equipment, or computer peripheral equipment.

7. The antenna array as claimed in claim 6, further comprising a connecting conductor line connected between signal sources of a plurality of the antenna arrays, wherein a length of the connecting conductor line is between ⅕ wavelength and ½ wavelength of a lowest operating frequency of the at least one common communication system band covered by the first antenna and the second antenna.

8. The antenna array as claimed in claim 7, wherein the connecting conductor line comprises a capacitor or an inductor element or structure.

9. The antenna array as claimed in claim 1, further comprising matching circuits, switching circuits, filter circuits, diplexer circuits, or circuits, elements, chips or modules consisting of capacitors, inductors, resistors and a transmission line provided between the first signal feeding conductor line and the first signal source, or provided between the second signal feeding conductor line and the second signal source.

10. The antenna array as claimed in claim 1, wherein a coupling conductor line is provided between the first antenna and the second antenna, wherein a first coupling slit is provided between the coupling conductor line and the first antenna, and wherein a second coupling slit is provided between the coupling conductor line and the second antenna.

11. The antenna array as claimed in claim 10, wherein a gap width of the first coupling slit and a gap width of the second coupling slit are both less than or equal to 0.063 wavelength of a lowest operating frequency of the at least one common communication system band covered by the first antenna and the second antenna.

12. The antenna array as claimed in claim 11, wherein a length of the coupling conductor line is between ⅓ wavelength and ¾ wavelength of the lowest operating frequency of the at least one common communication system band covered by the first antenna and the second antenna.

* * * * *